US006688659B2

(12) United States Patent
Kobrehel

(10) Patent No.: US 6,688,659 B2
(45) Date of Patent: Feb. 10, 2004

(54) EGRESS WINDOW LATCHING MECHANISM

(75) Inventor: Michael D. Kobrehel, Elkhart, IN (US)

(73) Assignee: Atwood Mobile Products Inc., Rockford, IL (US)

( * ) Notice: Subject to any disclaimer, the term of this patent is extended or adjusted under 35 U.S.C. 154(b) by 0 days.

(21) Appl. No.: 10/008,302

(22) Filed: Dec. 7, 2001

(65) Prior Publication Data

US 2003/0107221 A1 Jun. 12, 2003

(51) Int. Cl.[7] ..... E05C 1/12

(52) U.S. Cl. ..... 292/171; 292/DIG. 20; 49/141

(58) Field of Search ..... 292/4–6, 170, 292/171, 58, 61, DIG. 20; 49/141

(56) References Cited

U.S. PATENT DOCUMENTS

| | | | | | |
|---|---|---|---|---|---|
| 1,910,102 | A | * | 5/1933 | Godfrey | |
| 3,815,944 | A | | 6/1974 | Noga | 292/261 |
| 3,927,492 | A | | 12/1975 | Carson | 49/141 |
| 4,186,953 | A | | 2/1980 | O'Connor | 292/210 |
| 4,635,396 | A | | 1/1987 | Ranz et al. | 49/141 |
| 4,955,159 | A | * | 9/1990 | Rogers | 49/161 |
| 5,090,750 | A | * | 2/1992 | Lindqvist | 292/7 |
| 5,169,205 | A | * | 12/1992 | James | 296/146 |
| 5,398,447 | A | * | 3/1995 | Morse | 49/185 |
| 5,787,643 | A | | 8/1998 | Schmuck | 49/141 |
| 5,941,022 | A | | 8/1999 | Schmuck | 49/141 |

* cited by examiner

*Primary Examiner*—Gary Estremsky
(74) *Attorney, Agent, or Firm*—Peter D. McDermot; Casimir R. Kiczek

(57) ABSTRACT

A window assembly includes a pane defining a plane, and a latch bolt housing mounted to the pane. A latch bolt is slidingly mounted to the latch bolt housing for movement in a plane substantially parallel to the plane of the pane between a first position and a second position. A biasing member is operative to urge the latch bolt toward the first position, and a release handle remote from the latch bolt is operative to move the latch bolt from the first position toward the second position against a biasing force of the biasing member.

13 Claims, 7 Drawing Sheets

EGRESS WINDOW LATCHING MECHANISM

FIELD OF THE INVENTION

The present invention relates to window assemblies, and more particularly to egress window assemblies for passenger vehicle windows.

BACKGROUND

Window designs for passenger vehicles such as recreational vehicles ("RV's"), busses, and railroad cars can provide alternate means of exiting in case of an emergency. Typically, such windows include a framed panel attached via a hinge to the wall of the vehicle, and a latch assembly. The window can be quickly unlatched and pivoted outward, allowing passengers to exit the vehicle by way of the window. The latches of these windows must typically meet stringent specifications. They must hold the window in place with sufficient force to provide a watertight seal and minimize vibrations and noise, yet provide for easy unlatching. They should ideally extend into the interior of the vehicle as little as possible so as not to reduce usable interior space. Further, they must meet the requirements of Federal Motor Vehicle Safety Specifications, including, for example, FMVSS 217. Additionally, they should be able to provide constant latch engagement despite manufacturing tolerance stack-up. Finally, they should be inexpensive to produce, install, and maintain.

Commercially available latches for vehicle egress windows do not meet all of these requirements. One type of latch mechanism is seen in FIGS. 12–13, where it is shown without the window with which the assembly is associated. A latch bolt 100 includes a lower extension 102 having a triangular cross-section that, when in a first position, engages an upwardly-biasing leaf spring 104. One face of latch bolt 100 is connected to a handle 106, and its opposite face is connected to a horizontally-biasing spring 108. Rotation of handle 106 actuates latch bolt 100, pulling it horizontally and monolinearly from a first latched position, seen in FIG. 12, to a second unlatched position, seen in FIG. 13, such that lower extension 102 slides off of leaf spring 104, permitting the window to be swung outwardly to an open position. Horizontally-biasing spring 108 pulls latch bolt 100 back to the latched position upon the window being opened and handle 106 being released. Upon shutting, triangular lower extension 102 slides up an angled portion of leaf spring 104, which compresses until lower extension 102 clears the top of leaf spring 104, at which point leaf spring 104 snaps upward and reengages lower extension 102, relatching the window without any further manipulation of the latch mechanism. This automatic relatching upon shutting the window is known as "slam-shut," and is desirable in that it requires less time and effort to latch the windows after opening them.

Another common latch mechanism for a window assembly includes keepers mounted on a structural frame around a window opening and pivotable members mounted on the rim of the window that snap over the keepers. This design is inexpensive, but requires two hands to operate, which is impractical and will not meet current specifications on certain typical larger windows. The keepers require mounting holes and fasteners and usually the removal of trim. The keepers are of such a size that they project inwardly of the vehicle an amount that presents a hazard to passengers exiting through the window, and interferes with seating space. Further, the design will not withstand variances in manufacturing tolerance stack up, and require constant adjustment of the keepers to provide the requisite snap action. The degree of force required to open and close the latches is quite high.

Another type of latch mechanism is described in U.S. Pat. No. 3,927,492 to Carson. In Carson, an inner window frame and an outer window frame support a window, and the latching mechanism has an articulated linkage that folds into a contoured channel of the inner window frame in a way that latches the window shut. An actuating lever, which comprises a facing or trim molding extension, actuates the latch to a release position. The molding is pulled downward, levering the linkages out of the latched position and permitting the window to be opened. In this mechanism, no biasing means are present to return the latch automatically to the latched position, thus, "slam-shut" operation is not possible.

The latch mechanism of U.S. Pat. No. 4,635,396 to Ranz et al. is similar to that of Carson in that the latch involves a series of linkages and a molding piece that acts as an actuating lever. In this mechanism, the linkages move with the window when it is opened, and there is a shoulder mounted to a bottom support that engages with the latch bolt to latch the window shut. The Ranz latch is opened by pulling the molding upward, thus disengaging the latch bolt from the shoulder. As with Carson, no biasing means are present to permit the latch to close automatically and provide for "slam-shut" operation.

It is an object of the present invention to provide a latching mechanism that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a window assembly includes a pane defining a plane, and a latch bolt housing mounted to the pane. A latch bolt is slidingly mounted to the latch bolt housing for movement in a plane substantially parallel to the plane of the pane between a first position and a second position. A biasing member is operative to urge the latch bolt toward the first position, and a release handle remote from the latch bolt is operative to move the latch bolt from the first position toward the second position against a biasing force of the biasing member.

In accordance with another aspect, a window assembly includes a pane and a hinge mounted along a first peripheral edge of the pane. A latch assembly includes a latch bolt housing mounted to a second peripheral edge of the pane and defining a cavity. A latch bolt is slidingly received in the cavity, and has one or more compound mounting pin slots and a beveled latch portion. The latch portion is operative to engage a shoulder of a vehicle. At least one mounting pin is secured to the latch bolt housing and is slidably received in a corresponding mounting pin slot for compound sliding movement of the latch bolt between a latched position and an unlatched position. A spring mounted to the latch bolt housing is operative to urge the latch bolt into the latched position. A release handle mounted to the pane remote from the latch bolt is operative to move the latch bolt into the unlatched position against a biasing force of the spring.

In accordance with yet another aspect, a window assembly includes a pane and a hinge mounted along a first peripheral edge of the pane. A latch assembly includes a latch bolt housing mounted to a second peripheral edge of the pane and defining a cavity. A latch bolt is slidingly received in the cavity, and has a pair of compound mounting pin slots and a beveled latch portion. The latch portion is operative to engage a shoulder of a vehicle. The compound mounting pin slots have a first segment extending substantially parallel to the second peripheral edge, a second segment extending substantially parallel to the second peripheral edge and laterally offset from the first segment, and a third segment extending at an angle with respect to the second peripheral edge and connecting the first and second segments. A pair of mounting pins are secured to the latch bolt housing and slidably received in corresponding mounting pin slots for compound sliding movement of the latch bolt between a latched position and an unlatched position. A spring is mounted to the latch bolt housing, and is operative to urge the latch bolt into the latched position. A release handle is mounted to the pane remote from the latch bolt, and is operative to move the latch bolt into the unlatched position against a biasing force of the spring.

From the foregoing disclosure, it will be readily apparent to those skilled in the art, that is, those who are knowledgeable or experienced in this area of technology, that the present invention provides a significant technological advance. Preferred embodiments of the present invention can provide a latching mechanism for a window that is easy to operate, provides slam-shut capability, and allows for constant latch engagement despite manufacturing tolerance stack-up. These and additional features and advantages of the invention disclosed here will be further understood from the following detailed disclosure of certain preferred embodiments.

DETAILED DESCRIPTION OF CERTAIN PREFERRED EMBODIMENTS

Figure 1:
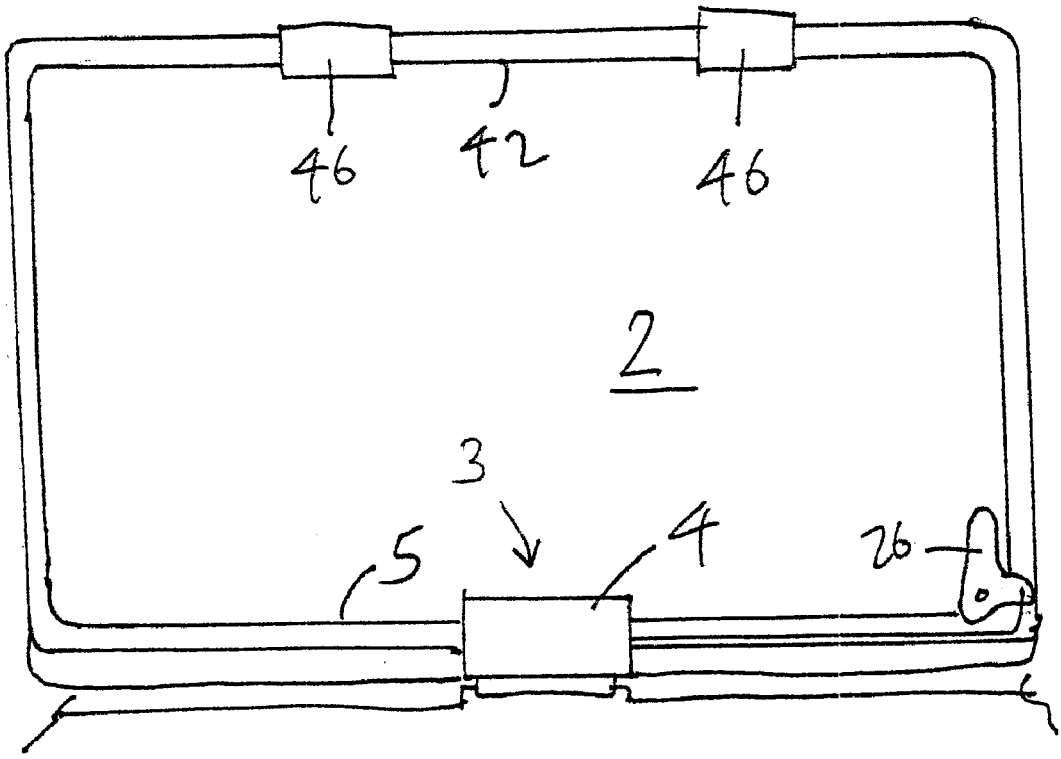
FIG. 1 is an elevation view of a preferred embodiment of a window assembly in accordance with the present invention.

It will be understood by those skilled in the art that the window assemblies disclosed and described herein are suitable for use in numerous applications, including recreational vehicles, mass transit vehicles, and passenger vehicles.

In the preferred embodiment shown in FIGS. 1–7, a window assembly 1 has a transparent panel or pane 2, preferably made of glass, plastic, or a multilayered combination of the two. Pane 2 has a first peripheral edge 42, opposite a second peripheral edge 5. First peripheral edge 42 is hingedly mounted to a first support member 41, as described in greater detail below with respect to FIG. 11.

Window assembly 1 has a latch bolt assembly 3 slidingly mounted to pane 2 for movement between a first position and a second position in a plane substantially parallel to a plane defined by the pane. In certain preferred embodiments, latch assembly 3 includes a latch bolt housing 4 that is mounted to the pane 2, preferably proximate second peripheral edge 5 of pane 2, remote from first peripheral edge 42. The phrase "mounted to the pane" as used herein means mounted either directly or indirectly to the pane such that the mounted object travels with the pane when the window is opened and closed. Latch bolt housing 4 can be mounted to pane 2 by screws, bolts, rivets, adhesive, or any other suitable fastening means that will be readily apparent to those skilled in the art, given the benefit of this disclosure.

Figure 4:
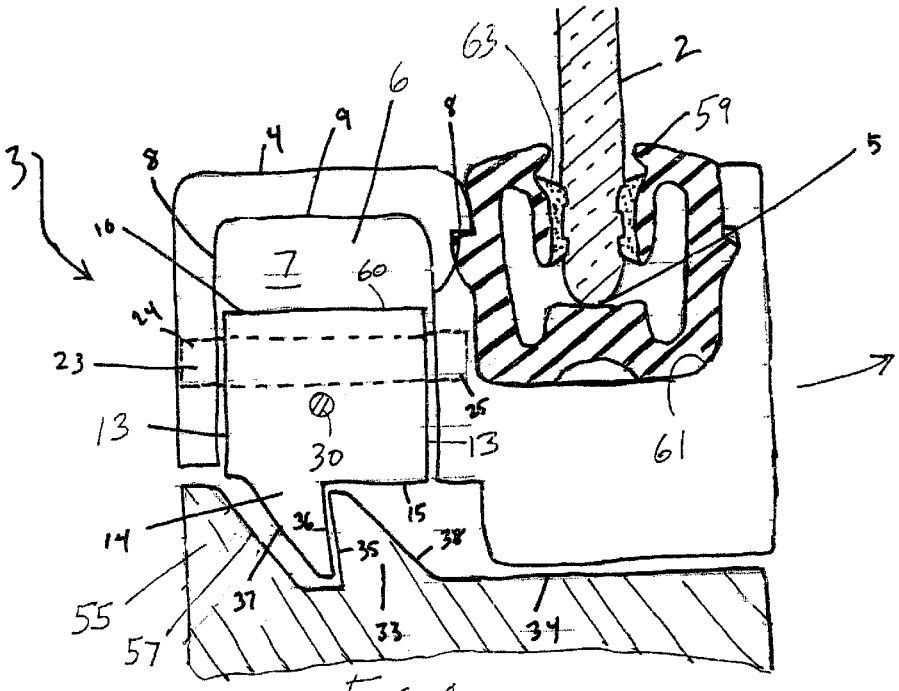
FIG. 4 is an elevation view of the latch assembly of FIG. 2, shown in its latched position with respect to a shoulder of a vehicle.
Figure 6:
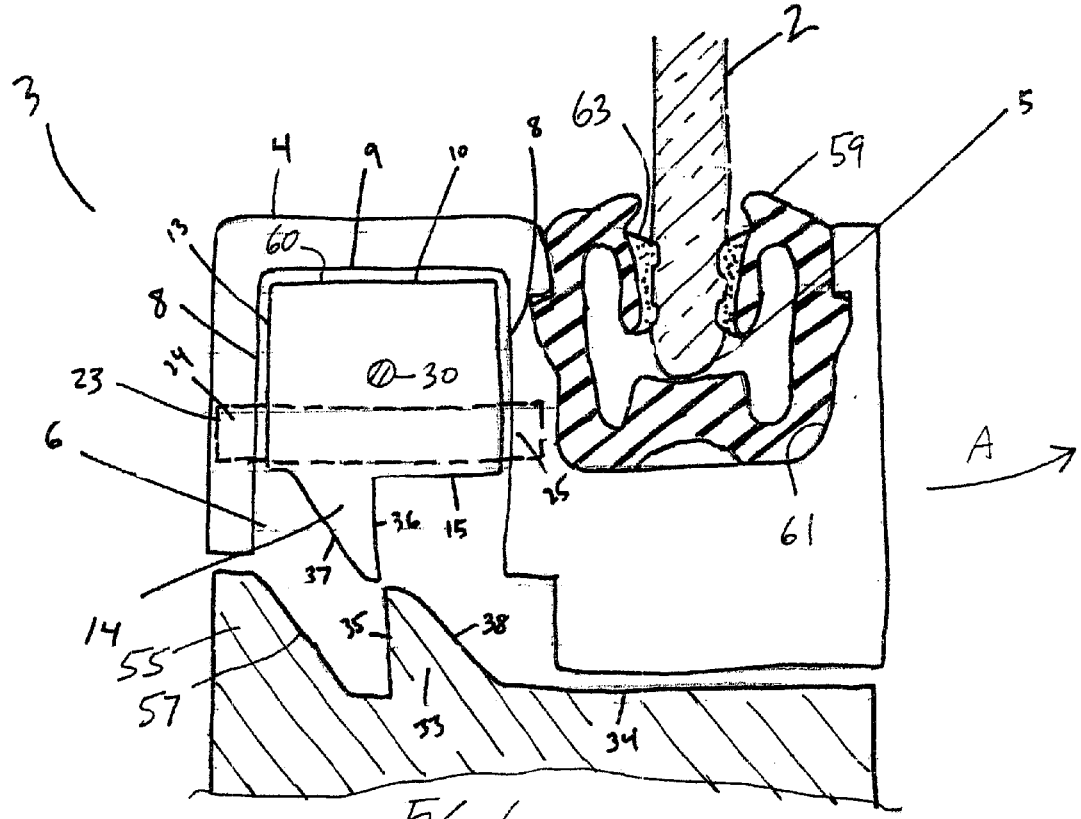
FIG. 6 is an elevation view of the latch assembly of FIG. 2, shown in its unlatched position with respect to a shoulder of a vehicle.
Figure 7:
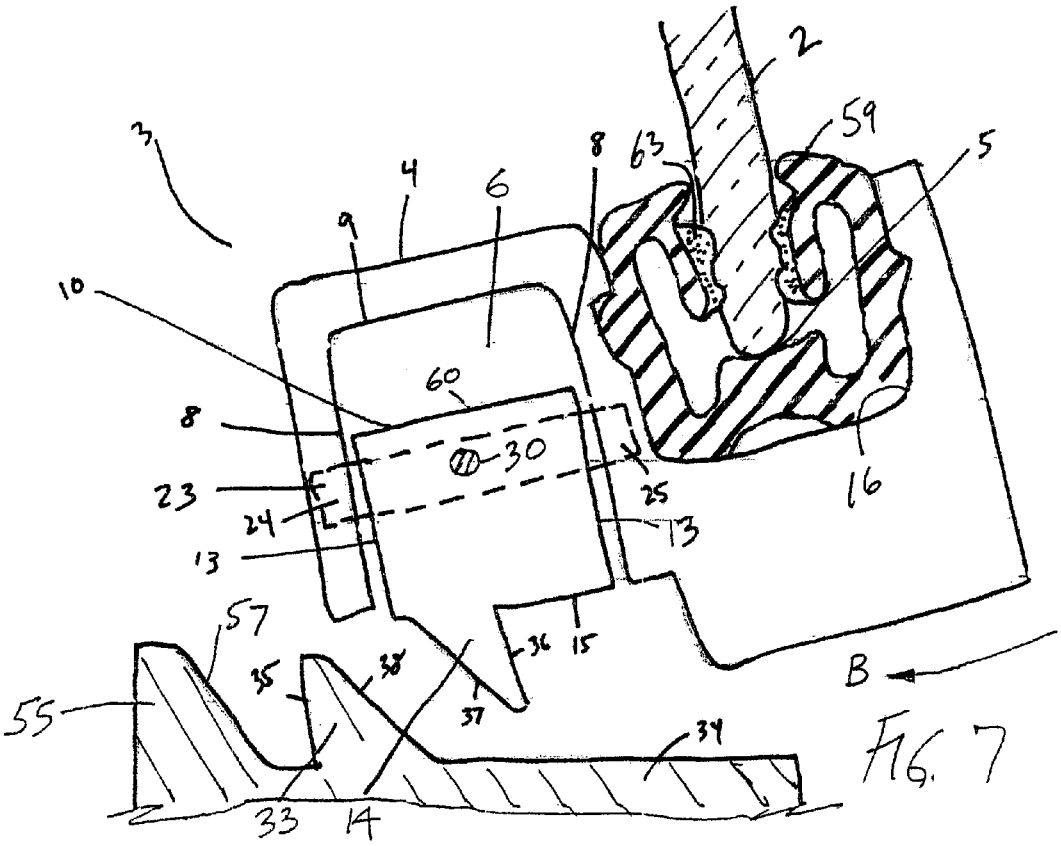
FIG. 7 is an elevation view of the latch assembly of FIG. 2, shown in its unlatched position with respect to a shoulder of a vehicle, and with the window swung outwardly into an open position.

Latch bolt housing 4 is preferably formed of injection molded thermoplastic or a structural metal, e.g., aluminum. Other appropriate materials for latch bolt housing 4 will become readily apparent to those skilled in the art, given the benefit of this disclosure. Latch bolt housing 4 defines a cavity 6 having two side surfaces 8, a top surface 9, and, optionally, a back surface 7. Cavity 6 opens in a direction extending away from second peripheral edge 5 of pane 2 and in a direction extending away from back surface 7. As can be seen in FIGS. 4, 6, 7, second peripheral edge 5 is received by a seal 59, which is in turn received in a recess 61 of latch bolt housing 4. Seal 59 is typically secured to pane 2 by adhesive 63.

Latch bolt assembly 3 includes a latch bolt 10 having a front surface 11, a back surface 12, two side surfaces 13, a top surface 60, and a bottom surface 15. In certain preferred embodiments, side surfaces 13 of latch bolt 10, as well as side surfaces 8 of cavity 6, may contain recesses 62 (shown in FIG. 3 on side surface 13) so as to reduce the amount of surface area that will come in contact with other members, thereby reducing friction and the force required to operate the latch.

A biasing member such as a spring 20 is connected at a first end 21 to back surface 12 of latch bolt 10 and is connected at a second end 22 to back surface 7 of cavity 6. In embodiments where cavity 6 has no optional back surface, spring 20 can be connected at second end 22 to a spring pin, not shown, extending across cavity 6 in similar fashion as the mounting pins described below. Spring 20 serves to bias the latch bolt 10 to a first, typically closed, position, shown in FIG. 2. The biasing member may be, as noted above, a spring, e.g., a coil spring or leaf spring, or it may alternatively be elastic or resilient bands. Other suitable means for biasing the latch bolt to the first position will be readily apparent to those skilled in the art, given the benefits of this disclosure. Latch bolt 10 optionally has a beveled latch portion 14 extending downwardly from bottom surface 15.

One or more, preferably two, compound mounting pin slots 16 extending through latch bolt 10. The term compound mounting pin slot, when used herein, refers to a slot that has an angular, serpentine or curvilinear shape, and is not monolinear, that is, it does not have the form of a straight line. In certain preferred embodiments, compound mounting pin slots 16 are formed of a first segment 17 extending from a position proximate front surface 11 and top surface 60, toward back surface 12, substantially parallel to second peripheral edge 5. A second segment 19 extends from a position proximate bottom surface 15 and back surface 12, toward front surface 11, laterally offset from first segment 17 and substantially parallel to second peripheral edge 5 and first segment 17. A third segment 18 connects first segment 17 to second segment 19, and extends at an angle with respect to second peripheral edge 5 and first and second slots 17, 19.

Figure 8:
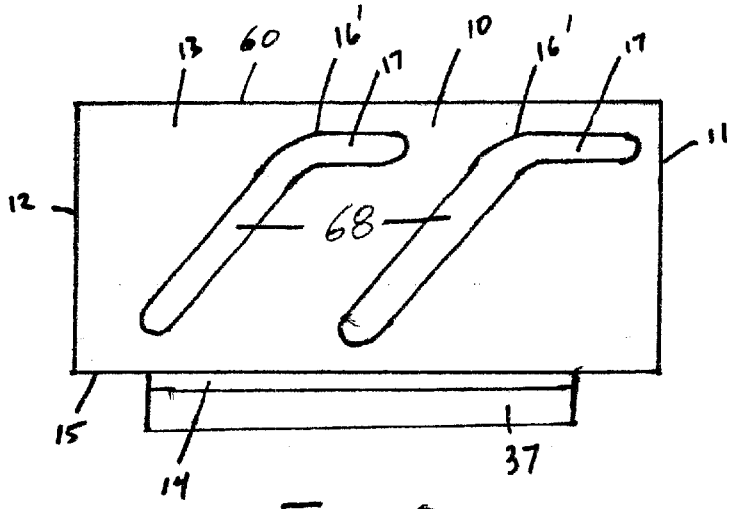
FIG. 8 is an elevation view of an alternative embodiment of the latch bolt of the latch assembly of FIG. 2.

In other preferred embodiments, such as that illustrated in FIG. 8, where greater closing forces are required, compound mounting pin slots 16' may comprise a first segment 17 extending from a position proximate front surface 11 and top surface 60, toward back surface 12, substantially parallel to second peripheral edge 5, and a second segment 68 extending from a position proximate bottom surface 15 and back surface 12 to first segment 17 at an angle with respect to second peripheral edge 5 and first segment 17. Other configurations for the compound mounting pin slots including, for example, curvilinear slots or slots comprising multiple curvilinear segments; which would result in the latch bolt, upon being actuated as described below, moving in a forward and upward direction, will be readily apparent to those skilled in the art, given the benefit of this disclosure.

In certain preferred embodiments, as seen in FIGS. 2–7, one or more, preferably two, mounting pins 23 are attached at first ends 24 to a side surface 8 of cavity 6, and extend substantially perpendicular to the plane of the pane 2 into cavity 6. Each mounting pin 23 extends through a corresponding compound mounting pin slot 16 to slidingly mount latch bolt 10 to latch bolt housing 4. Mounting pins 23 typically comprise aluminum, steel, or other metal, and can be attached by any conventional method, e.g., welding. Alternatively, mounting pins 23 may be bolts extending through holes formed in the latch bolt housing and held in place by nuts. Other suitable materials for the mounting pins and attachment means will be readily apparent to those skilled in the art, given the benefit of the present disclosure.

Figure 9:
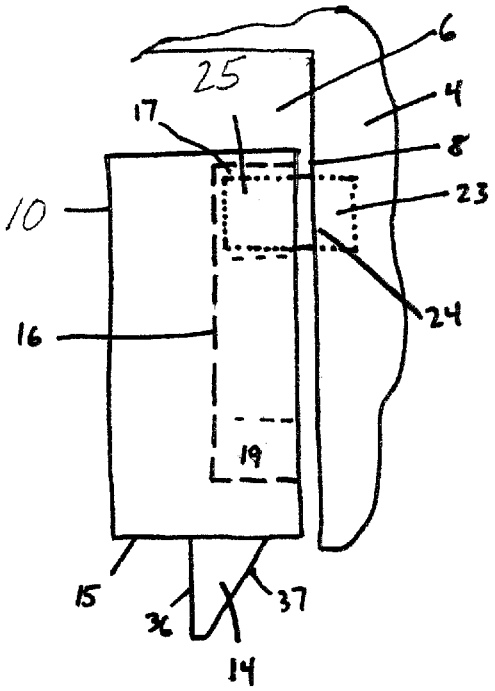
FIG. 9 is an elevation view of another alternative embodiment of the latch bolt of the latch assembly of FIG. 2.

In certain preferred embodiments, such as those illustrated in FIGS. 4, 6, and 7, mounting pins 23 are attached at second ends 25 to the opposing side surface 8 of cavity 6. In other preferred embodiments, such as that illustrated in FIG. 9, mounting pins 23 are attached only at a first end 24 to a side surface 8. In such an embodiment, a second end 25 of a mounting pin 23 extends only into a compound mounting pin slot 16, and does not extend completely through latch bolt 10. Consequently, in this embodiment, compound mounting pin slots 16 need not extend entirely through latch bolt 10, but, rather, need to extend only far enough to accommodate the length of mounting pin 23. Further, in such an embodiment, mounting pin 23 may be attached to either side surface 8 of cavity 6.

In an alternative embodiment, mounting pins 23 can be formed as extensions of side surface 8 such that latch bolt housing 10 and mounting pins 23 are unitary, that is, they are of one-piece construction. Other suitable mounting configurations will be readily apparent to those skilled in the art, given the benefits of this disclosure.

Figure 2:
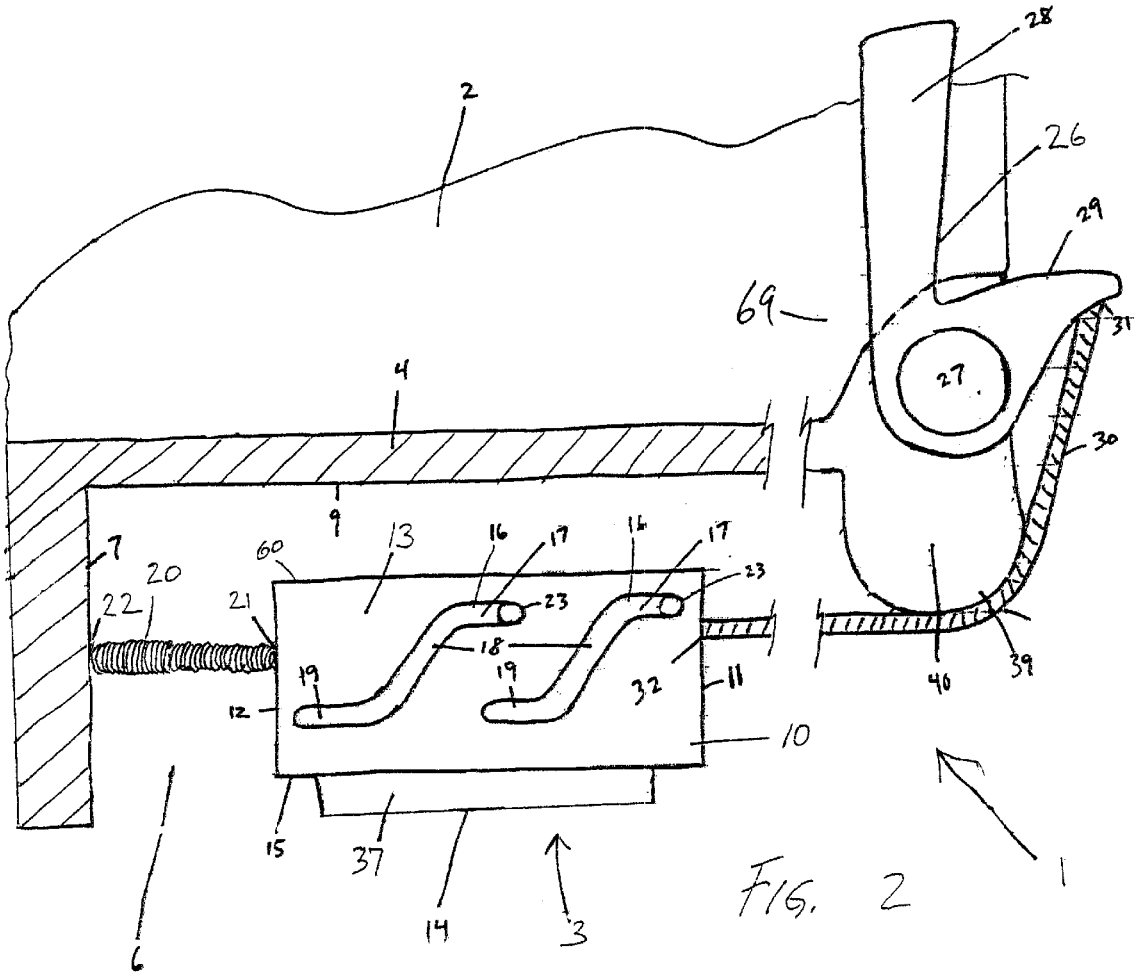
FIG. 2 is a section view, shown partially broken away, of a latch assembly of the window assembly of FIG. 1.

As seen in FIG. 2, a release mechanism 69 remote from latch bolt 10 is used to move latch bolt 10 from the first position toward the second position. In a preferred embodiment, release mechanism 69 includes a release handle 26. In certain preferred embodiments, release handle 26 is pivotally mounted at pivot pin 27 to pane 2 remote from latch bolt 10, that is, release handle 26 is not directly rigidly affixed to latch bolt 10. However, it is understood that release handle 26 is connected to latch bolt 10, either directly or indirectly, as described below with respect to a preferred embodiment.

Release handle 26, in certain preferred embodiments, includes a handle portion 28, extending preferably in an upward direction when the latch is in the closed position, attached to a cam 29 which pivots around pivot pin 27. An actuating cable 30 is attached at a first end 31 to cam 29 and at a second end 32 to front face 11 of latch bolt 10. In certain preferred embodiments, actuating cable 30 runs along a directional channel 39 that extends below pivot pin 27 and translates the direction of actuating cable 30 from its attachment at cam 29 to the attachment at latch bolt 10 so that actuating cable 30 runs in a horizontal fashion from directional channel 39, substantially parallel to second peripheral edge 5, to latch bolt 10. Directional channel 39 may be a groove formed in a handle base 40. Directional channel 39 may, in other preferred embodiments, include a pulley wheel pivotally connected to handle base 40, operable to rotate with actuating cable 30 as the latch is opened as described below.

In still other preferred embodiments, pivot pin 27 of release handle 26 is itself attached to handle base 40, with directional channel 39 located on the lower portion of cam 29, which serves to translate the direction of actuating cable 39. Release handle 26 is capable of rotating to move latch bolt 10 into the second, typically unlatched, position. In certain preferred embodiments, release handle 26 rotates through a minimum of 45° to move latch bolt 10 from the first position to the second position, which is advantageous in that the average user associates such a degree of rotation with unlatching a window. Consequently, the use will be more aware that the window is unlatched and ready to be opened, particularly in an emergency situation. Further, in certain preferred embodiments, cam 29 functions to increase the leverage that release handle 26 applies to actuating cable 30 near the completion of the rotation of release handle 26, providing a noticeable lessening of force required to complete the rotation, and providing feedback via that lessening of force to the operator so that they might realize the window has become unlatched. Other suitable release handles, and other suitable means for moving the latch bolt from the first position toward the second position, will be readily apparent to those skilled in the art, given the benefit of this disclosure.

In certain preferred embodiments, the latch bolt comprises means for engaging a second support of the vehicle. Such means can be the latch bolt extending directly into a slot in the second support or can be via a portion of the latch bolt abutting the second support or an extension of the second support, or can be an extension of the latch bolt extending into a slot on the second support or abutting the second support or an extension of the second support. Alternatively, the second support could comprise an extension that extends into a slot or cavity defined by the bottom face of the latch bolt. Still other means include one or more U-shaped hooks extending downwardly from the latch bolt and open in a direction proximate the back face of the latch bolt which engage an equal number of posts attached to the second support, directly molded with the second support, or contained within a slot or cavity of the second support, wherein the cavity of the second support is open upwardly to permit the hooks to enter and engage the posts. Other latch bolts comprising means for engaging an engaging portion of a second support will be readily apparent to those skilled in the art, given the benefits of this disclosure.

In certain preferred embodiments, as seen in FIGS. 3–7, a shoulder 33 extends upwardly from a second support member 34 of the vehicle. An engaging face 35 of shoulder 33 is engageable with engaging face 36 of the beveled latch portion 14 when latch bolt 10 is in the first position. Both engageable faces 35 and 36 optionally extend substantially vertical and parallel to the plane of pane 2. In other preferred embodiments, engaging face 35 may form an angle slightly less than 90° with respect to second support member 34, and engaging face 36 may form the same angle with respect to bottom face 15 of latch bolt 10, such that a slight resistance exists to the moving of latch bolt 10 from the first position to the second position as described below (or such that a positive engagement is provided when latched). A second face 37 of beveled latch portion 14 and a second face 38 of shoulder 33 may be straight or optionally may be curvilinear, particularly an S-shaped curve. The two second faces 37, 38 are operable to slide over each other and permit "slam-shut" closure of the window as described below. Second support 34 further includes a lip 55 having a face 57 that faces engaging face 35. Face 57 has a shape mating with the shape of second face 37 such that when latch bolt 10 is in its latched position, lip 55 retains latch bolt 10 in an inboard-outboard direction. Other suitable configurations of shoulder 33 and beveled latch portion 14 will be readily apparent to those skilled in the art, given the benefit of this disclosure.

Figure 10:
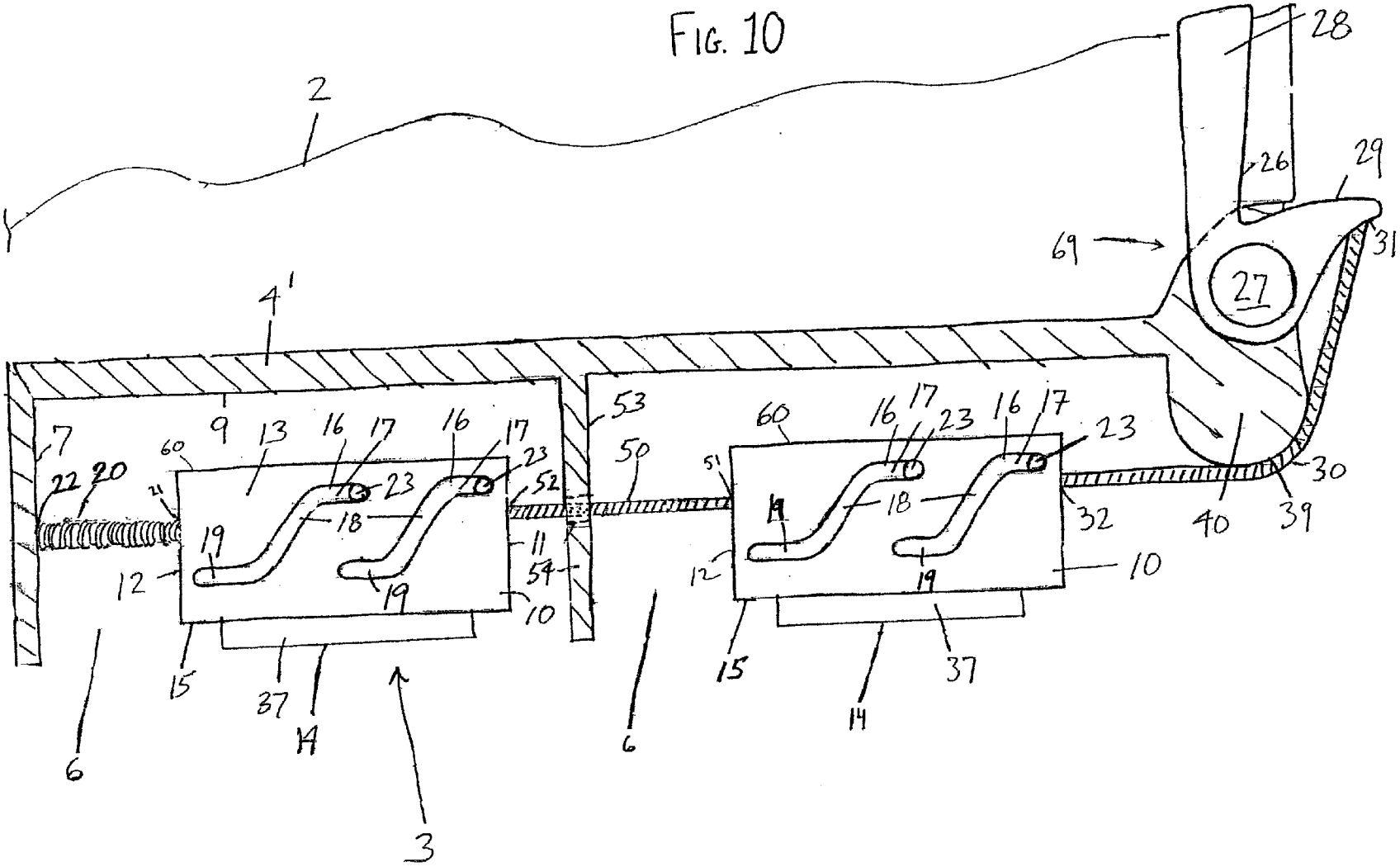
FIG. 10 is a section view, shown partially broken away, of an alternative embodiment of the latch assembly of FIG. 2.
Figure 12:
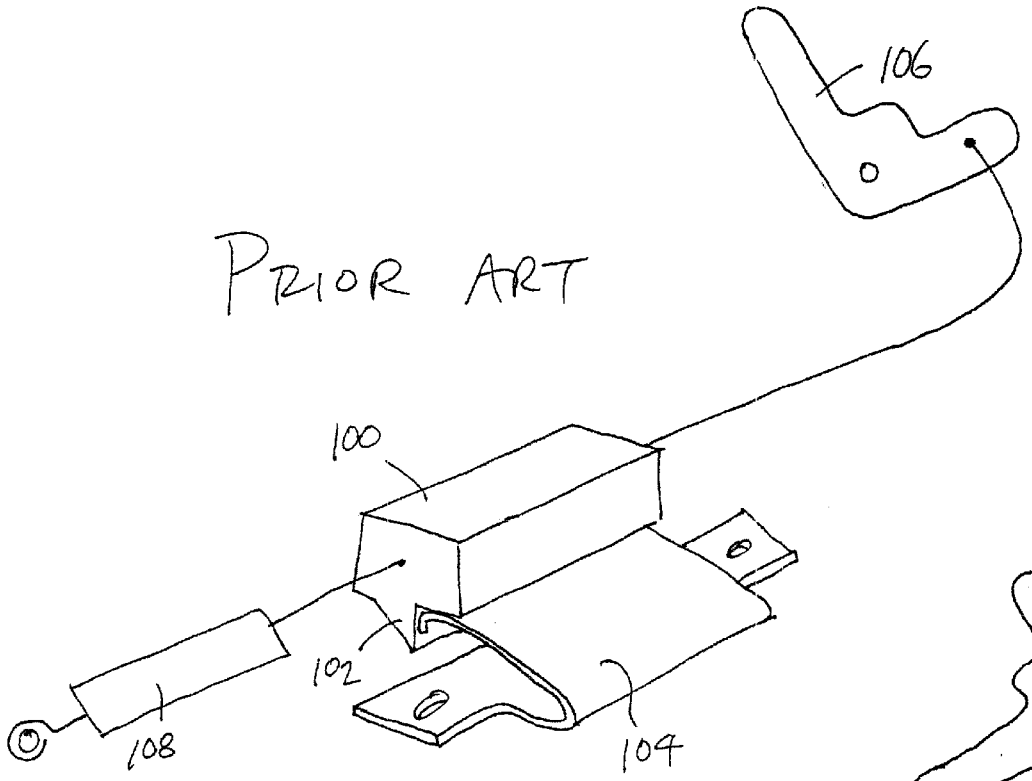
FIG. 12 is a perspective view of a latch assembly of the prior art, shown in its latched position.
Figure 13:
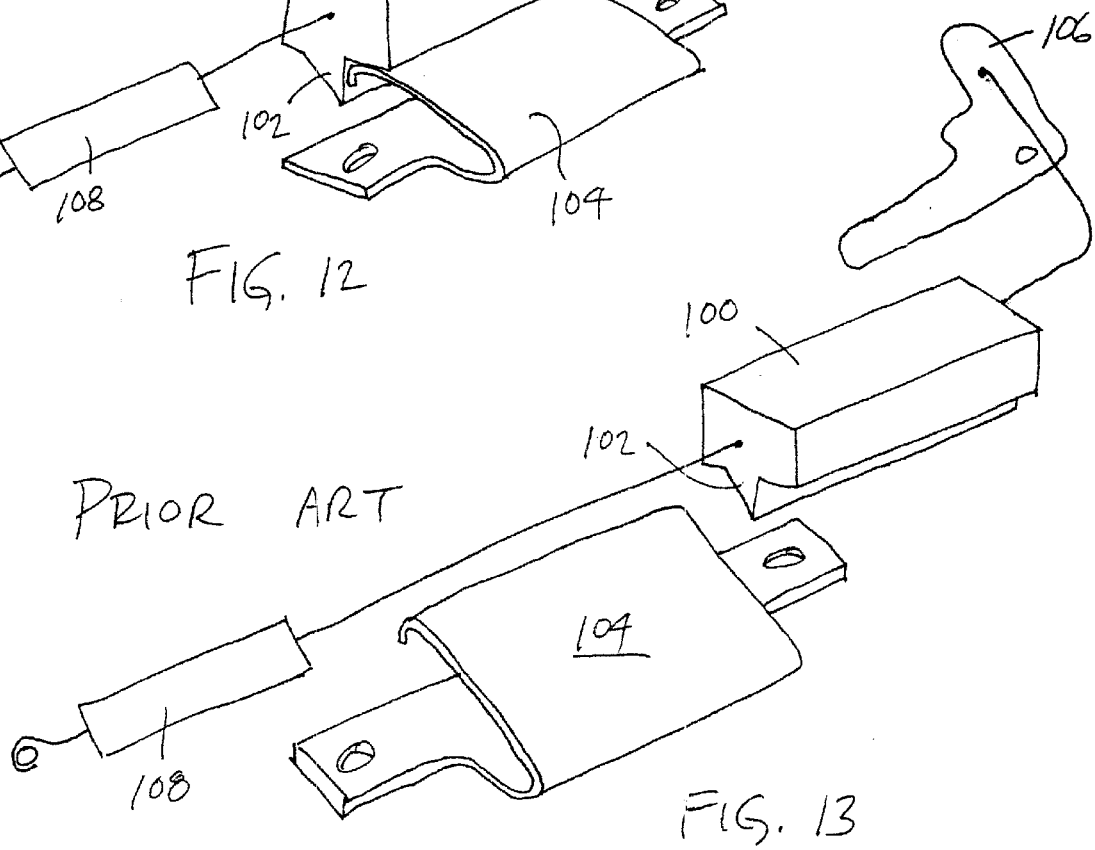
FIG. 13 is a perspective view of the latch assembly of FIG. 12, shown in its unlatched position.

In certain preferred embodiments, the window assembly as described above can comprise multiple latch bolts. Each latch bolt in such an embodiment will essentially be a mirror image of the other and will be mounted in the same fashion described above. The multiple latches can be actuated by either a single or multiple release handles, and can be urged towards a first position by either a single biasing member or multiple biasing members. One such preferred embodiment is seen in FIG. 10. In addition to the structure found in FIG. 2, this embodiment includes a connecting cable 50 attached at a first end 51 to back surface 12 of a first latch bolt 10, and attached at a second end 52 to front surface 11 of a second latch bolt 10. Latch housing 4' may optionally comprise an intermediate span 53 extending downward from top surface 9 of cavity 6 and containing a channel 54 through which connecting cable 50 travels. A tie bar could optionally be used in place of connecting cable 50 to operatively connect latch bolts 10.

Figure 11:
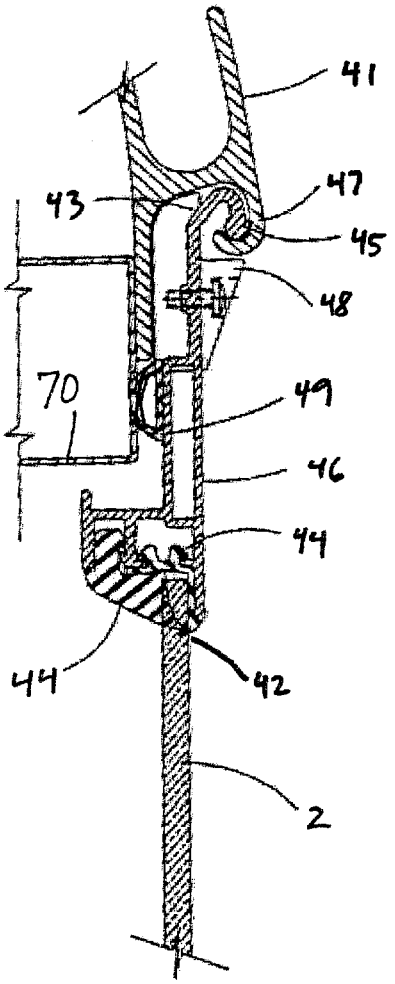
FIG. 11 is a section view, shown partially broken away, of the hinge member of the window assembly of FIG. 1.

A typical hinged mounting is displayed in FIG. 11. A hinge 43 is mounted to a base member 46. First peripheral edge 42 of pane 2 is mounted to base member 46 by means of interference fit seals 44. Hinge 43 has an inverted U-shaped flange 45. The end of flange 45 is preferably rounded or cylindrical in shape, and to facilitate pivotal movement of pane 2, flange 45 is positioned in a hook-shaped flange 47 extending from first support 41. First support 41 may be the exterior wall of the vehicle, or a separate member secured to the vehicle. Base member 46, hinge 43, U-shaped flange 45, and hook-shaped flange 47 preferably are either injection molded thermoplastic or structural metal. Other suitable materials for these elements will be apparent to those skilled in the art, given the benefit of this disclosure. An elastomer seal 49 is preferably adhesively attached to base member 46 to engage a frame member 70 of the vehicle to provide a weather resistant seal and to reduce vibrational noise. A hinge retainer 48 is optionally attached to hinge 43 to ensure that hinge 43 does not disengage from hook-shaped flange 47, thereby preventing pane 2 from falling or otherwise being removed from the vehicle. Other suitable hinge designs will be readily apparent to those skilled in the art, given the benefit of this disclosure.

It is to be appreciated that first support 41 and second support 34 can be separately assembled with pane 2, i.e. preassembled, or can be assembled at the time of installation of the window assembly. It will be understood by those skilled in the art, given the benefit of this disclosure, that in certain preferred embodiments first and second supports 41, 34 will be two separate and distinct elements, whereas in other preferred embodiments the first and second supports may comprise separate elements that have been joined into a single element, i.e. an assembled multi-piece frame. In still other preferred embodiments, first and second supports 41, 34 may refer to different portions of a single unitary support, i.e. a one-piece frame or the vehicle wall to which the window assembly is mounted.

Figure 3:
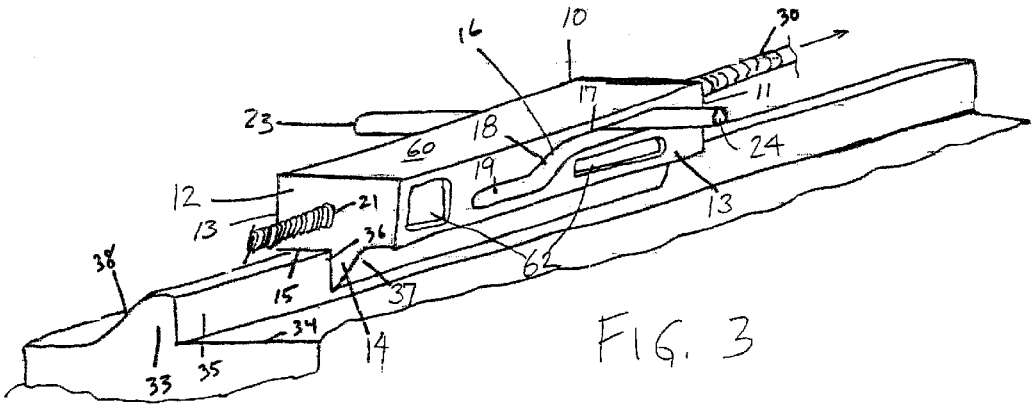
FIG. 3 is a perspective view of the latch bolt of the latch assembly of FIG. 2, shown in its latched position with respect to a shoulder of a vehicle.
Figure 5:
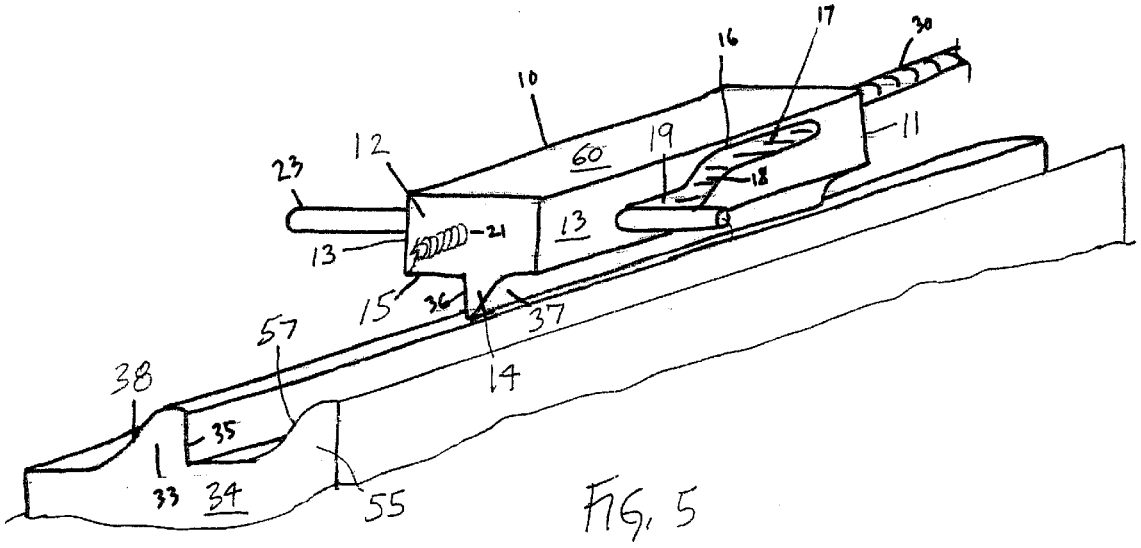
FIG. 5 is a perspective view of the latch bolt of the latch assembly of FIG. 2, shown in its unlatched position.

The mode of operation of certain preferred embodiments of the present invention will now be described. As can be seen in FIGS. 2–4, when the window is closed, latch bolt 10 is in the first or latched position, held there by the biasing of the spring 20. Engaging face 36 of latch bolt 10 is engaged with engaging face 35 of shoulder 33, and serves to prevent the window from being opened. To open the window, release handle 26 is turned or pivoted downward, and cam 29 serves to draw the first end of actuating cable 30 along with it as handle 26 is rotated. This motion of the first end of actuating cable 30 is translated via directional channel 39 to a horizontal movement of latch bolt 10 in a direction opposite the bias of spring 20. Upon experiencing this biasing force, latch bolt 10 moves in a horizontal direction with mounting pins 23 moving along first segment 17 until they encounter third segments 18. Latch bolt 10 then moves in an angular direction upward until mounting pins 23 encounter second segments 19. Latch bolt then moves horizontally as mounting pins move within second segments 19 to the second position, where mounting pins 23 encounter the ends of compound mounting pin slots 16. Accordingly, the movement of latch bolt 10 is a compound sliding movement, that is, an angular, serpentine or curvilinear movement, corresponding to mounting pins 23 moving along the compound mounting pin slots 16, and is not a monolinear or straight movement. This motion of latch bolt 10 draws beveled latch portion 14 away from spring 20 and upward with respect to second support 34, such that beveled latch portion 14 and shoulder 33 are disengaged upon the completion of movement of latch bolt 10, as seen in FIGS. 5 and 6. This removes all obstacles to swinging pane 2 outwardly in the direction of arrow A, seen in FIG. 6, to open the window, permitting egress.

Upon the window being opened and release handle 26 being released to its original position, spring 20 biases latch bolt 10 back to the first position, as can be seen in FIG. 7. At this point, the window can be closed and latched from the exterior of the vehicle merely by slamming the window shut in the direction of arrow B. When second face 37 of beveled latch portion 14 encounters second face 38 of shoulder 33, the angle of the faces combines with the closing force being exerted to lever latch bolt 10 upwardly in the direction dictated by compound mounting pin slots 16 against the bias of spring 20 until the lower edge of beveled latch portion 14 clears the upper edge of shoulder 33. Upon beveled latch portion 14 clearing shoulder 33 and the window swinging fully shut, spring 20 biases latch bolt 10 back into the first position, moving beveled latch portion 14 down such that it reengages shoulder 33 and latches the window shut.

Various illustrative embodiments of the invention having been shown and described above by way of example only. It is anticipated that variations to these described assemblies will occur to those skilled in the art in light of the present disclosure and that such modifications and changes may be made without departing from the spirit of the invention, or the scope of the appended claims.

I claim:

1. A window assembly comprising:

a pane defining a plane;

a latch bolt housing mounted to the pane;

a latch bolt slidingly mounted to the latch bolt housing for movement in a plane substantially parallel to the plane of the pane between a first position and a second position;

a biasing member operative to urge the latch bolt toward the first position;

a release handle remote from the latch bolt and operative to move the latch bolt from the first position toward the second position against a biasing force of the biasing member; and at least one compound mounting pin slot in the latch bolt wherein each compound mounting pin slot comprises a first segment extending substantially parallel to a peripheral edge of the pane, a second segment extending substantially parallel to the peripheral edge of the pane and laterally offset from the first segment, and a third segment connecting the first and second segments.

2. A window assembly comprising:

a pane defining a plane;

a latch bolt housing mounted to the pane;

a latch bolt slidingly mounted to the latch bolt housing, the latch bolt adapted for compound sliding movement in a plane substantially parallel to the plane of the pane between a first position and a second position;

a biasing member operative to urge the latch bolt toward the first position;

a release handle remote from the latch bolt and operative to move the latch bolt from the first position toward the second position against a biasing force of the biasing member; and a shoulder, wherein the latch bolt includes a beveled latch portion operative to engage the shoulder.

3. A window assembly comprising:

a pane defining a plane;

a latch bolt housing mounted to the pane;

a latch bolt slidingly mounted to the latch bolt housing, the latch bolt adapted for compound sliding movement in a plane substantially parallel to the plane of the pane between a first position and a second position;

a biasing member operative to urge the latch bolt toward the first position; and a release handle remote from the latch bolt and operative to move the latch bolt from the first position toward the second position against a biasing force of the biasing member, wherein the release handle comprises a cam with a handle and a cable having a first end connected to the cam and a second end connected to the latch bolt.

4. A window assembly comprising:

a pane;

a hinge mounted along a first peripheral edge of the pane; and a latch assembly comprising:

a latch bolt housing mounted to a second peripheral edge of the pane and defining a cavity, a latch bolt slidingly received in the cavity, having one or more compound mounting pin slots and a beveled latch portion, the latch portion being operative to engage a shoulder of a vehicle;

at least one mounting pin secured to the latch bolt housing and slidably received in a corresponding mounting pin slot for compound sliding movement of the latch bolt between a latched position and an unlatched position;

a spring mounted to the latch bolt housing, operative to urge the latch bolt into the latched position; and a release handle mounted to the pane remote from the latch bolt, operative to move the latch bolt into the unlatched position against a biasing force of the spring.

5. The window assembly of claim 4, wherein the latch assembly is self-latching.

6. The window assembly of claim 4, wherein the beveled latch portion and the shoulder cooperatively interact with each other to move the latch bolt from the latched position to the unlatched position and back to the latched position when the pane is moved from an open position to a closed position.

7. The window assembly of claim 4, wherein the latch bolt has two compound mounting pin slots and the latch bolt housing includes two mounting pins.

8. The window assembly of claim 4, wherein the compound mounting pin slots comprise a first segment extending substantially parallel to the second peripheral edge, a second segment extending substantially parallel to the second peripheral edge and laterally offset from the first segment, and a third segment extending at an angle with respect to the second peripheral edge and connecting the first and second segments.

9. The window assembly of claim 4, wherein the compound mounting pin slots each comprise a first segment extending substantially parallel to the second peripheral edge, and a second segment extending at an angle with respect to the second peripheral edge and connected to the first segment.

10. The window assembly of claim 4, wherein the release handle comprises a cam with a handle and a cable having a first end connected to the cam and a second end connected to the latch bolt.

11. A window assembly comprising:

a pane;

a hinge mounted along a first peripheral edge of the pane; and a latch assembly comprising:

a latch bolt housing mounted to a second peripheral edge of the pane and defining a cavity;

a latch bolt slidingly received in the cavity, having a pair of compound mounting pin slots and a beveled latch portion, the latch portion being operative to engage a shoulder of a vehicle, the compound mounting pin slots comprising a first segment extending substantially parallel to the second peripheral edge, a second segment extending substantially parallel to the second peripheral edge and laterally offset from the first segment, and a third segment extending at an angle with respect to the second peripheral edge and connecting the first and second segments;

a pair of mounting pins secured to the latch bolt housing and slidably received in corresponding mounting pin slots for compound sliding movement of the latch bolt between a latched position and an unlatched position;

a spring mounted to the latch bolt housing, operative to urge the latch bolt into the latched position; and a release handle mounted to the pane remote from the latch bolt, operative to move the latch bolt into the unlatched position against a biasing force of the spring.

12. A window assembly comprising:

a pane defining a plane;

a latch bolt housing mounted to the pane;

a latch bolt slidingly mounted to the latch bolt housing, the latch bolt adapted for compound sliding movement in a plane substantially parallel to the plane of the pane between a first position and a second position;

a biasing member operative to urge the latch bolt toward the first position; and a release handle remote from the latch bolt and operative to move the latch bolt from the first position toward the second position against a biasing force of the biasing member, wherein the latch bolt is adapted for compound sliding movement along a path comprising a first path segment substantially parallel to a peripheral edge of the pane followed by a second path segment angularly connected to the first path segment followed by a third path segment angularly connected to the second path segment and substantially parallel to the peripheral edge of the pane and laterally offset from the first path segment.

13. A method of operating a window assembly comprising:

providing a window assembly comprising a pane defining a plane, a latch bolt housing mounted to the pane, a latch bolt slidingly mounted to the latch bolt housing for movement in a plane substantially parallel to the plane of the pane between a first position and a second position, a biasing member operative to urge the latch bolt toward the first position, and a release handle remote from the latch bolt and operative to move the latch bolt from the first position toward the second position against a biasing force of the biasing member; and moving the latch bolt from the first position to the second position along a path comprising a first segment substantially parallel to a peripheral edge of the pane, a second segment substantially parallel to the peripheral edge of the pane and laterally offset from the first segment, and a third segment connecting the first and second segments.

* * * * *